US010655413B2

(12) United States Patent
Brandsdal et al.

(10) Patent No.: US 10,655,413 B2
(45) Date of Patent: May 19, 2020

(54) DESTRUCTION MECHANISM FOR A DISSOLVABLE SEALING DEVICE

(71) Applicant: TCO AS, Indre Arna (NO)

(72) Inventors: Viggo Brandsdal, Indre Arna (NO); Jan Tore Tveranger, Indre Arna (NO)

(73) Assignee: TCO AS, Tyssedal (NO)

( * ) Notice: Subject to any disclaimer, the term of this patent is extended or adjusted under 35 U.S.C. 154(b) by 189 days.

(21) Appl. No.: 15/578,888

(22) PCT Filed: May 31, 2016

(86) PCT No.: PCT/NO2016/050111
§ 371 (c)(1),
(2) Date: Dec. 1, 2017

(87) PCT Pub. No.: WO2016/195508
PCT Pub. Date: Dec. 8, 2016

(65) Prior Publication Data

US 2018/0156002 A1 Jun. 7, 2018

(30) Foreign Application Priority Data

Jun. 1, 2015 (NO) ..... 20150701

(51) Int. Cl.
*E21B 19/00* (2006.01)
*E21B 33/12* (2006.01)
(Continued)

(52) U.S. Cl.
CPC ..... *E21B 29/00* (2013.01); *E21B 33/1208* (2013.01); *E21B 34/063* (2013.01)

(58) Field of Classification Search
CPC ..... E21B 33/12; E21B 33/134; E21B 34/063; E21B 33/1208; E21B 29/00
See application file for complete search history.

(56) References Cited

U.S. PATENT DOCUMENTS 5,479,986 A * 1/1996 Gano ..... E21B 23/00 166/292
5,685,372 A * 11/1997 Gano ..... E21B 23/00 166/292
(Continued)

FOREIGN PATENT DOCUMENTS

EP 0681087 A2 11/1995
GB 2527462 A * 12/2015
(Continued)

OTHER PUBLICATIONS

PCT International Search Report and Written Opinion dated Aug. 30, 2016, issued in corresponding application No. PCT/NO2016/050111 filed on May 31, 2016, 10 pgs.
(Continued)

*Primary Examiner* — Daniel P Stephenson
(74) *Attorney, Agent, or Firm* — Chamberlain Hrdlicka

(57) ABSTRACT

A sealing device relates to a plug that includes a crusher mechanism, where the sealing device includes one or more glass layers positionable in a wellbore. The glass in a barrier phase bears against at least one seat or support sleeve arranged axially displaceably in the wellbore, where the at least one seat or support sleeve bears against the glass by means of a supporting hydraulic fluid in a pressure support chamber, the seat or support sleeve being configured to be released, be displaced axially, and to crush the glass when the supporting hydraulic fluid is released from the pressure support chamber.

22 Claims, 3 Drawing Sheets

(51) Int. Cl.
*E21B 34/06* (2006.01)
*E21B 29/00* (2006.01)

(56) References Cited

U.S. PATENT DOCUMENTS 5,947,204 A * 9/1999 Barton ..... E21B 33/1295 166/317
6,076,600 A * 6/2000 Vick, Jr. ..... E21B 33/1208 166/192
7,909,104 B2 * 3/2011 Bjorgum ..... E21B 33/1208 166/376
8,220,538 B2 * 7/2012 Wee ..... E21B 33/1208 166/145
8,322,448 B2 * 12/2012 Brandsdal ..... E21B 33/12 166/376
9,441,437 B2 * 9/2016 Fripp ..... E21B 34/063
9,732,579 B2 * 8/2017 Hiorth ..... E21B 33/1208
9,850,734 B2 * 12/2017 Wee ..... E21B 33/12
2007/0163776 A1 * 7/2007 Sorensen ..... E21B 33/12 166/179
2010/0163222 A1 * 7/2010 Brandsdal ..... E21B 33/134 166/192
2011/0000663 A1 * 1/2011 Brandsdal ..... E21B 33/12 166/178
2011/0000676 A1 * 1/2011 Brandsdal ..... E21B 33/12 166/317
2011/0277988 A1 * 11/2011 Wee ..... E21B 33/1208 166/192
2013/0228338 A1 * 9/2013 Brandsdal ..... E21B 23/04 166/317
2014/0338923 A1 * 11/2014 Fripp ..... E21B 34/063 166/376
2016/0060998 A1 * 3/2016 Hiorth ..... E21B 33/1208 166/192
2016/0281455 A1 * 9/2016 Brandsdal ..... E21B 33/12
2018/0156002 A1 * 6/2018 Brandsdal ..... E21B 29/00
2018/0245421 A1 * 8/2018 Brandsdal ..... E21B 33/1204

FOREIGN PATENT DOCUMENTS

NO 321976 B1 7/2006
NO 325431 B1 4/2008
NO 331150 B1 10/2011
RU 2013110514 A 9/2014
RU 2586342 C1 6/2016
WO 2008127126 A2 10/2008
WO 2009110805 A1 9/2009
WO 2009116871 A1 9/2009
WO WO-2009116871 A1 * 9/2009 ..... E21B 33/1204
WO 2009126049 A1 10/2009
WO 2012060713 A1 5/2012
WO WO-2014017921 A1 * 1/2014
WO 2014154464 A2 10/2014
WO WO-2017034416 A1 * 3/2017 ..... E21B 33/1204

OTHER PUBLICATIONS

PCT International Preliminary Report on Patentability dated Sep. 12, 2017, issued in corresponding application No. PCT/NO2016/050111 filed on May 31, 2016, 7 pgs.

* cited by examiner

DESTRUCTION MECHANISM FOR A DISSOLVABLE SEALING DEVICE

The present disclosure relates to a crusher mechanism for a sealing device. The present disclosure incorporates the entire disclosure of PCT Application Publication No. WO 2016/195508 A1 for all purposes, including specifically the entire disclosure relating to the disclosed embodiments of the destruction mechanism and sealing device.

BACKGROUND

Such sealing devices may be dissolvable and may be used, for example, for pressure testing, where they also will function as barriers to the reservoir, in zone isolation or in borehole workover.

It is known to use plugs of a dissolvable material, such as glass, ceramic, salt, etc., where the plug may be removed or crushed after use in such a way as to leave behind very few remnants or fragments. Such plugs of a dissolvable material, if correctly configured, are removable with or without explosives in a predictable and safe manner.

Plugs comprising one or more glass layers stacked upon or above one another maybe removed without the use of explosives by utilizing techniques that include percussion tools, spikes that are thrust into the dissolvable material, balls or other articles that serve to create tensions in the dissolvable material, or puncturing of the layer disposed between the two or more glass layers (if plugs comprise more than one glass layer), where the volume contains a film or a sheet of a material other than glass.

This layer between the two or more glass layers, comprising a firm and/or a sheet of a material other than glass, may comprise a fluid, a plastic material, a rubber material, a felt material, a paper material, glue, grease, etc. The layer may be substantially solid or entirely or partially deformable/liquid. The volume between the glass layers, which may be provided with at least one of the aforementioned materials, will enable the plug to attain the desired strength and toughness during use by providing for the uptake of loads exerted on the plug in the form of a differential pressure between the under- and upper side of the plug. This may involve accommodation of loads in the form of load transfer, load distribution, or limitation of bulging as a result of frictional forces between two or more layers of glass or other suitable dissolvable or crushable materials.

If there is one glass layer, the plug during use must attain the desired strength and toughness through provision for the uptake of loads exerted on the plug in the form of a differential pressure between the under- and upper side of the one glass layer. This means that the one glass layer must be capable of receiving the entire load, both from above and below if required, on full load accommodation.

NO321976, filed on 21 Nov. 2003, describes a glass plug comprising a plurality of layers or stratiform glass discs between which are provided layers of a material other than glass. NO321976 is the very first patent publication that describes a layered glass plug. NO321976 explains why there should be provided strata or layers, as disclosed above, between the glass discs of a material other than glass, and is included in its entirely in this document.

NO325431, filed on 23 Mar. 2006, relates to an apparatus and method for crushing a dissolvable sealing device of the aforementioned type. NO325431 employs a relief chamber and an adjustable connecting means forming a fluid communication channel between the layer, the liquid film or the volume between the glass discs and relief chamber when the adjustable connecting means is set in an open position. When the adjustable connecting means is set in an open position, the content between the glass discs is «punctured» and evacuated, and the load on (one or more of) the glass layers exceeds what they are designed to tolerate, which causes them to rupture. In addition, the apparatus according to NO325431 comprises a plurality of pin devices which are arranged to apply point load stresses on the glass layers when the connecting means is readjusted, with the pin bodies additionally serving to ensure that the glass layers rupture in a safe manner when the connecting means is reset. Thus, the intended function of NO325431 is to provide for rupture of the plug through resetting of the connecting means to an open position so that the space between the glass layers is punctured and the pressure drops drastically and quickly. The pressure support function will thereby disappear, and the glass the glass layers will be bent until they rupture and disintegrate, one by one. In addition, NO325431 discloses the possibility of arranging pins around the glass layers, where the pins are designed to produce point load stresses in the glass to weaken the strength of the glass layers. The way the pins' function is disclosed in NO325431, the pins have either a «passive» function, i.e., they are stationary and come into contact with the glass layers when these are bent or after the adjustable connecting means has been activated, or the pins are «actively» activated by means of the adjustable connecting means when it is activated, i.e., the pins are pushed against the glass layers and thereby produce point load stresses. In both cases, the point load stresses by the pins are produced as a causal effect of activation of the adjustable connecting means, since it is a precondition for the disclosed function of the plug that the space between the glass layers is punctured and the pressure falls drastically and quickly, with the glass layers thereby being bent and thus point loaded or, alternatively, that the sum of the tensions produced in the glass layers when the space between the glass layers is punctured/evacuated and the pins are pressed into the glass layers exceeds the level of tolerance of the glass layers so that they rupture. Thus, the pins do not function alone; they are dependent on the condition that the content between the glass layers is evacuated.

NO331150 discloses a crushable plug, for example of glass, which comprises a plurality of pin devices (spikes, claws, tips, points, compression ring) which are actuated to press radially into a glass layer so that it ruptures, said glass layer comprising pre-formed weakened points/areas that facilitate the crushing when the pin devices are pressed in against the plug. It is further disclosed in NO331150 that the weakened areas are formed by virtue of microfractures in the glass, such as those caused by honing. If one examines FIG. 3 in NO331150, one sees disclosed fractures that spread inwardly in the glass from the points of the pin devices. This type of fracture formation is what is assumed to have occurred when glass plugs of this kind are crushed. Since the glass layers are pulverized by crushing, it has thus not been evident how these glass layers were crushed. NO331150 shows a plug comprising one single glass layer. Although the description does not rule this out, NO331150 shows no embodiment comprising several glass layers. NO331150 therefore provides no teaching as to how the disclosed solution could potentially be adapted to a plug comprising more than one glass layer.

The present disclosure relates to a crushable or dissolvable plug comprising one or more glass layers, optionally other suitable materials, where the plug is removed without the use of explosives, with the disclosure providing a crusher mechanism that is predictable, safe and easier to utilize.

BRIEF DESCRIPTION OF THE DRAWINGS

In the following is given a detailed description of embodiments of the present disclosure, with reference to the attached drawings, wherein.

DETAILED DESCRIPTION OF ILLUSTRATIVE EMBODIMENTS

Figure 1:
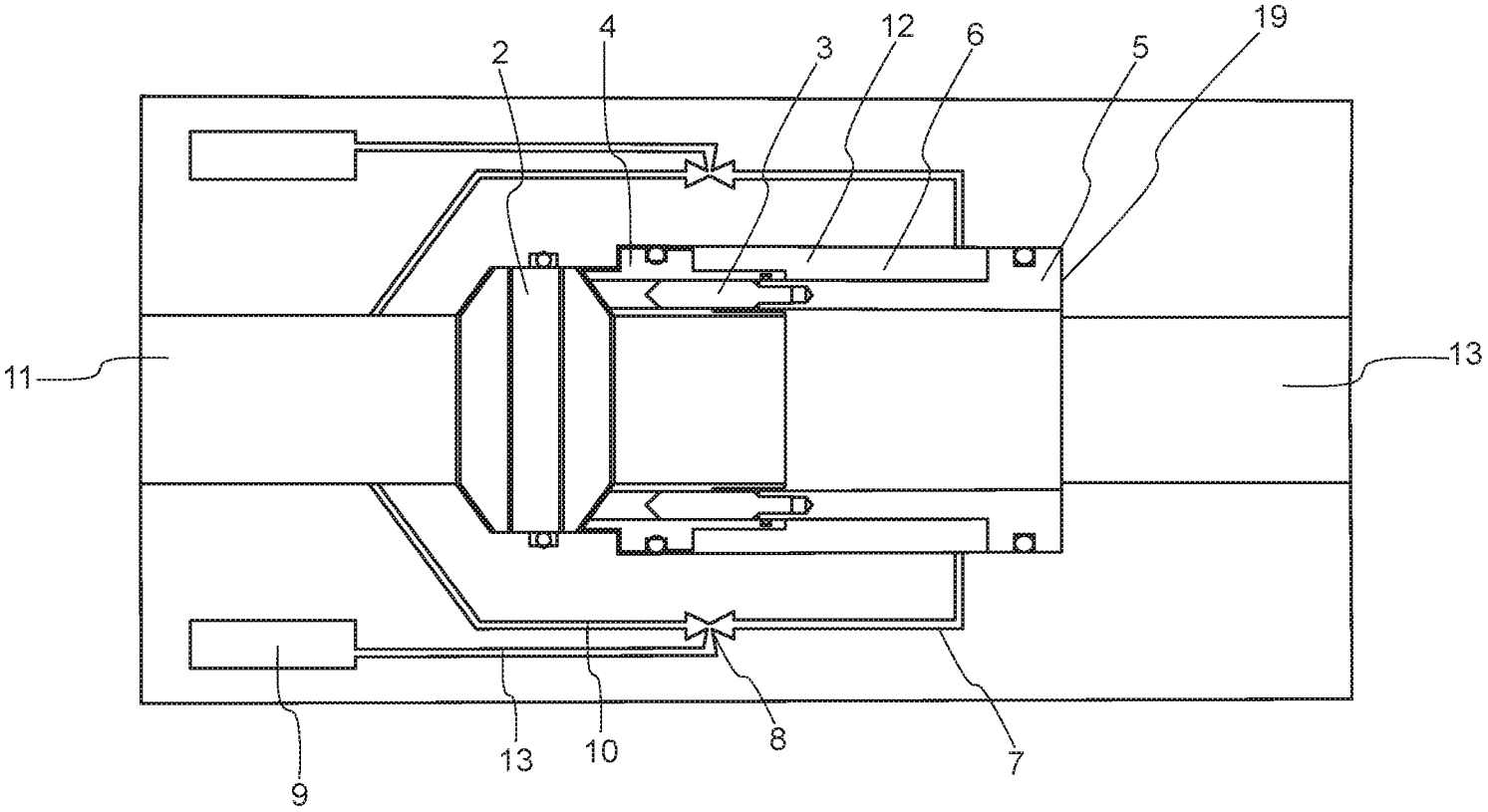
FIG. 1 shows an embodiment of a sealing device prior to crushing, where the plug comprises several glass layers.

FIG. 1 shows an embodiment of a sealing device 1, for example a plug, having a crusher mechanism comprising several glass layers 2, where one or more spikes 3 either bear, entirely or partially, against one or more sides of glasses 2, or are mounted at a distance from glass 2. The sealing device 1 may be dissolvable in that the glass is a dissolvable material. The embodiment in FIG. 1 shows that the spike or spikes are mounted at a distance from glass 2.

According to the embodiment shown in FIG. 1, the glasses 2 are supported by a support sleeve 4. Support sleeve 4 is arranged to be displaceable in an axial direction if there is a pressure support fluid 6 in a pressure support chamber 12. Pressure support chamber 12 is in communication with a relief chamber 9 for pressure support fluid 6. In the barrier phase for plug 1, pressure support fluid 6 will prevent the displacement of sleeve member 4 in an axial direction (toward the right in FIG. 1) as long as a valve 8 is closed. When valve 8 is opened, i.e., in a crushing phase, pressure support fluid 6 is released into relief chamber 9, and support sleeve 4 will be displaced in an axial direction (toward the right in FIG. 1) in such a way that the glasses are moved together with support sleeve 4 until the spike or spikes 3 strike and crush the glasses 2.

The spike or spikes 3 may be mounted in a separate sleeve member 5, which optionally may also be axially displaceable (toward the left in FIG. 1), but does not have to be. A potential advantage of having both support sleeve 4 and sleeve member 5 be displaceably mounted can be that the net acceleration between glasses 2 and spike or spikes 3 increases (i.e, they strike each other faster and harder), so that glasses 2 are crushed more predictably. Such an embodiment can thereby also enable the system to be constructed smaller, which conserves space.

It is understood that a further alternative embodiment may be that support sleeve 4 stays in fixed position and that only sleeve member 5, with spikes 3 mounted thereon, is axially displaced toward the left when pressure support fluid 6 is released from pressure support chamber 12.

Valve 8 may be mounted such that it is in communication with the upper side of the well tubing 11 (in contrast to the reservoir side 21). The valve is arranged such that when the pressure from the upper side 11 exceeds a certain level, then valve 8 opens for communication between pressure support chamber 12 and relief chamber 9 through channels 7 and 13. Valve 8 may also be controlled by other means, e.g., by pressure cycles, telemetry, or a signal of some kind.

Figure 2:
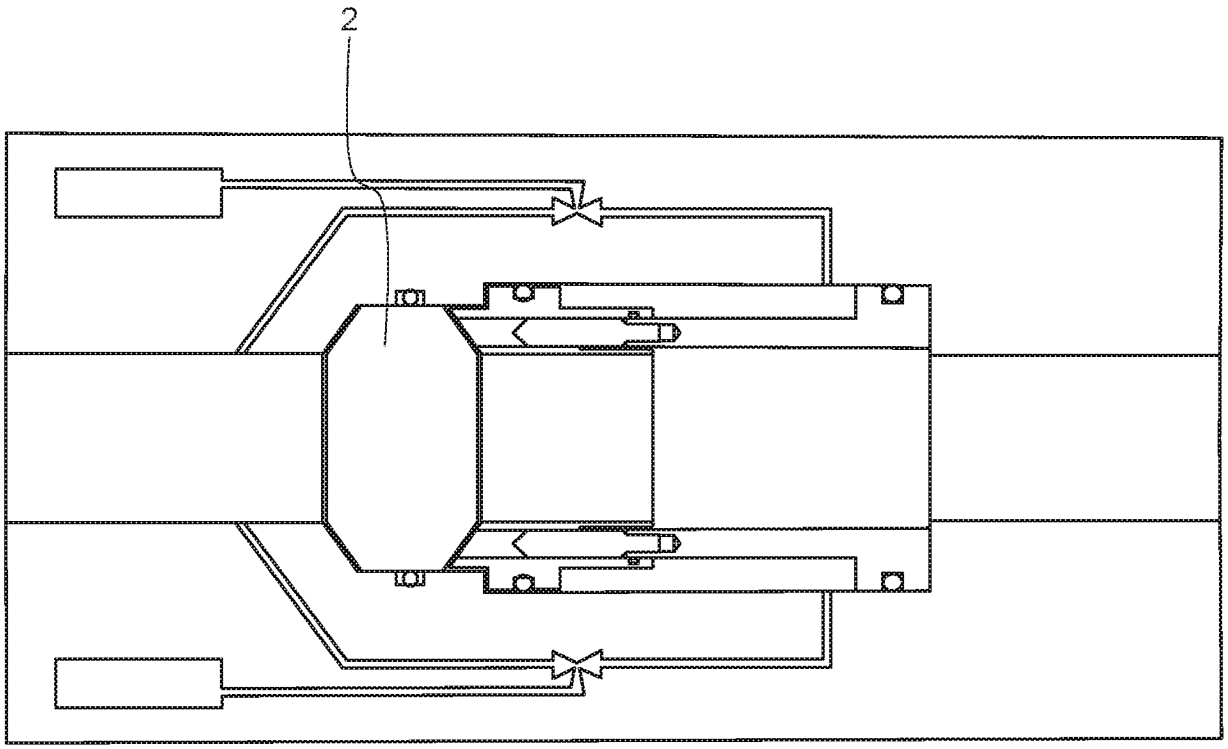
FIG. 2 shows a second embodiment of a sealing device prior to crushing, where the sealing device comprises one glass body.

FIG. 2 shows another embodiment of a sealing device where the sealing device has only one glass.

The sealing device includes plug 2 and various parts of the crusher mechanism comprise the sealing means in the form of O-rings and other relevant packings that are necessary in order for plug 2 to retain its seal during the barrier phase, at the same time as the crusher mechanism shall function as intended both during the barrier and the crusher phases (e.g., pressure support fluid 6 must under no circumstances be allowed to escape or leak out during the barrier phase).

Figure 3:
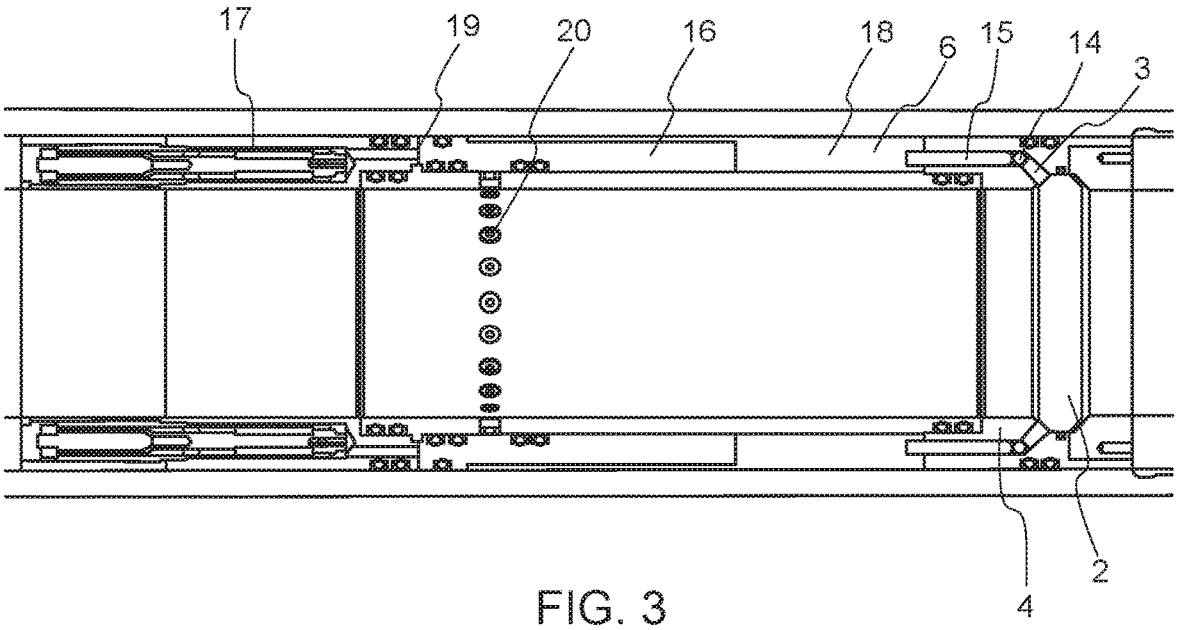
FIG. 3 shows a third embodiment of a sealing device prior to crushing.

FIG. 3 shows an alternative embodiment of the sealing device, that includes a plug. Here the spike or spikes 3 are diagonally mounted loosely at the glass (or glasses) 2, while a ball 14 functions as a power transmission means around a turn so that when an axial pin 15 is displaced (toward the right in FIG. 3), then spike 3 will move diagonally into glass 2.

This embodiment does not include a pressure support chamber, but instead comprises a chamber 18 having essentially a low or atmospheric pressure. Chamber 18 may contain air or another suitable gas.

An axially displaceable sleeve member 16 (displaceable toward the right in FIG. 3) is mounted in such a way that it, firstly, closes off a plurality of perforations 18 opening radially in toward the wellbore and, secondly, is in communication with a valve or release organ 22. In the barrier phase, valve or release organ 22 can serve to close off either a pressure chamber (not shown) containing a fluid under high pressure (substantially higher than the pressure in chamber 18), or a channel opening in toward the wellbore. In the crushing phase, valve 17 is opened so that sleeve 16 is displaced sufficiently far to uncover the perforations 20 opening radially in toward the wellbore, as the pressure in the wellbore is then let in at the upper side of sleeve 16, and exerts a pressure against the annulus 19. Sleeve member 16 will thereby be displaced with great force against pin(s) 15, which via balls 14 causes spikes 3 to be driven into glass 2, which is thereby crushed.

Figure 4:
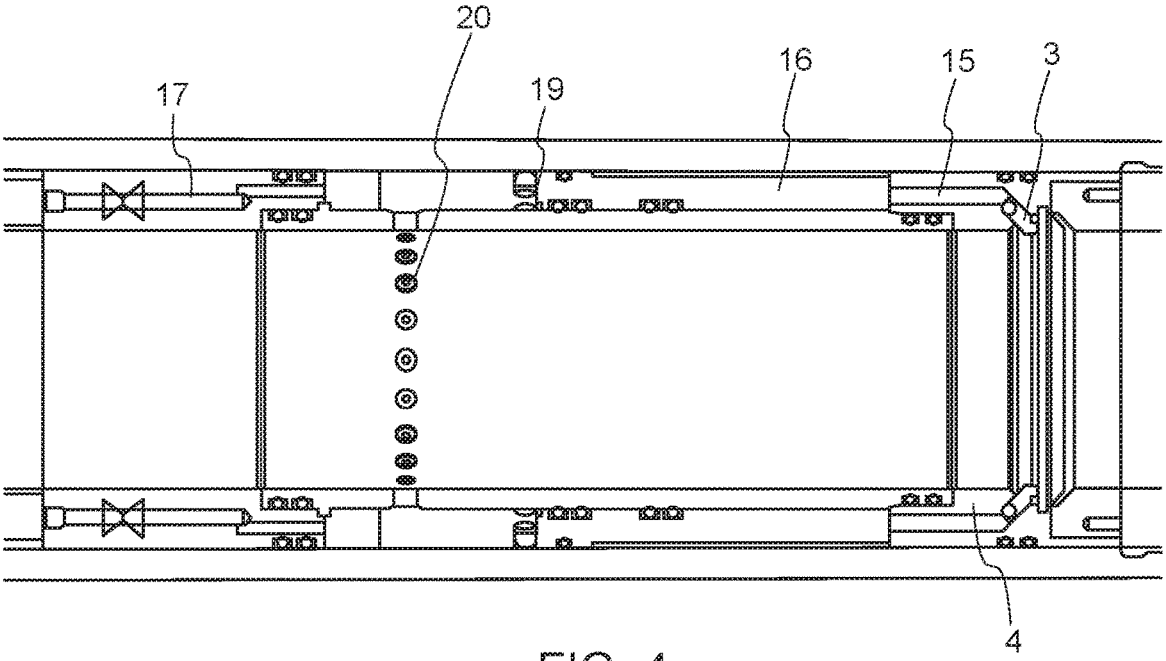
FIG. 4 shows the sealing device of FIG. 3 after the glass has been crushed.

FIG. 4 corresponds to the embodiment shown in FIG. 3 after the glass has been crushed.

Alternatively, valve or release organ 22 may comprise a spring member (not shown) which is held in restraint, whereby, upon being released, it shoves sleeve member 16 sufficiently far to uncover the perforations 18 opening radially in toward the wellbore.

Valve or release organ 22 may be controlled by, e.g., pressure cycles, telemetry, or a signal of some kind. A so-called ticker device may be an example of an organ which is triggered by means of pressure cycles.

Various aspects pertaining to the present disclosure, where some have already been mentioned above, are disclosed in the following:

According to one embodiment of the present disclosure, glass 2 in a barrier phase bears against at least one seat or support sleeve 4 arranged axially displaceably in the wellbore, where the at least one seat or support sleeve 4 bears against glass 2 by means of a supporting hydraulic fluid 6 found in a pressure support chamber 12, the seat or support sleeve 4 being arranged to be released, displaced axially, and to crush the glass 2 when the supporting hydraulic fluid 6 is released from its pressure support chamber 12.

The supporting hydraulic fluid may be locked in chamber 12 by means of a valve, bursting disc, shear pin, interchangeable part or a similar releasable mechanism 8. Other releasable mechanisms might also be contemplated.

Releasable mechanism 8 may also be triggered by means of a desired number of well pressure cycles from the well or by means of another signal. The releasable mechanism 8 maybe, for example, a ticker device.

In the crushing phase, releasable mechanism 8 permits supporting hydraulic fluid to flow out into one or more relief chambers 9. The pressure in the one or more relief chambers should, in that event, be lower than the pressure in the pressure support chamber, in which case the pressure in the one or more relief chambers 9 may be approximately atmospheric, but does not have to be. Releasable mechanism 8, e.g., a valve, may be mounted in such a way that after releasing the supporting pressure fluid, if this results in displacement of sleeve member 5 toward the left past channel 7, it opens through channel 10 and toward the well pressure in wellbore 11. In that event, sleeve member 5 will be subjected to strong pressure against annulus 19, whereupon the movement of the sleeve member is accelerated substantially and will strike the spike or spikes 3 with a powerful (more powerful) force.

According to another embodiment of the crusher mechanism, where glass 2 in a barrier phase also bears against at least one seat or support sleeve 4, the glass is crushed by the second sleeve member (16) being displaced when it is released.

It shall be understood that the phrase "the glass" is intended to denote one or more glass elements.

Between the at least one seat or support sleeve 4 and the second sleeve member 16, there may be arranged a fluid-filled chamber 18 having a lower pressure than the well pressure.

Alternatively, between the at least one seat or support sleeve 4 and the second sleeve member 16, there may be arranged a fluid-filled chamber 18 having a higher pressure than the well pressure.

The at least one seat or support sleeve 4 may be fixedly mounted in relation to the wellbore, but does not have to be. If there is a supporting hydraulic fluid 6 in chamber 18, then the seat or support sleeve 4 will remain stationary against the glass in the barrier phase. The fluid-filled chamber 18 may have a substantially lower pressure than the well pressure. Chamber 18 may contain air or another suitable gas.

Sleeve member 5; 16 may be arranged such that, in the barrier phase, it covers over a plurality of perforations 20 opening radially in toward the wellbore. In this case, sleeve member 5; 16 in the crushing phase may be arranged such that it uncovers a plurality of perforations 20 opening radially in toward the wellbore when sleeve member 5; 16 is displaced, thereby producing an additional powerful push against the annulus 19 of the sleeve, which causes the crusher device to strike more forcefully against the glass.

Also, in this and other embodiments the releasable mechanism may be triggered by means of a desired number of well pressure cycles from the well or another signal. The releasable mechanism 8 may be a so-called ticker device.

The releasable mechanism 8 can, in the crushing phase, cause the supporting hydraulic fluid to flow out into one or more relief chambers 9. This embodiment is not shown per se, but it shares features that are shown in FIGS. 1-2 and 3-4, respectively. In this case the pressure in the one or more relief chambers 9 may be lower than in the fluid-filled chamber 18, for example but not necessarily—approximately atmospheric.

Also, in this or other embodiments the crusher device may comprises spike means 3 which may include one or more of the group: spikes, pins, pegs, knives and annular casings.

It shall be understood that the various spike means may be tangentially, radially, diagonally and/or longitudinally mounted, or combinations of these. The annular casings may be formed with sharp edges or the like, but they do not have to be, since a hard blow against the glass can in itself be sufficient to crush the glass securely.

FIGS. 3 and 4 show that the releasable mechanism 17 may be positioned behind the second sleeve member 16, such that releasable mechanism 17 serves to push against an annulus 19 on second sleeve member 16 in the crushing phase.

Alternatively, the releasable mechanism 17 may be arranged in communication with the fluid-filled chamber 18 such that sleeve member 5; 16 in the crushing phase is displaced by being drawn by a negative pressure when releasable mechanism 17 permits fluid 6 to flow out from chamber 18 into the one or more relief chambers 9. Such an embodiment is basically shown in FIGS. 1 and 2, but it requires that the seat or support sleeve 4 remains stationary or is displaced substantially more slowly than sleeve member 5 and that the spike or spikes have a sufficient stroke length to strike the glass with sufficient force and security.

The invention claimed is:

1. A destruction mechanism for supporting and crushing a sealing device, wherein the sealing device comprises one or more glass layers positionable in a wellbore, the destruction mechanism comprising:

an axially displaceable glass supporting sleeve arranged to support the one or more glass layers by a hydraulic fluid locked in a support chamber;

a relief chamber in communication with the support chamber;

a crusher device arranged to crush the one or more glass layers; and wherein the glass supporting sleeve is arranged to be axially displaced together with the one or more glass layers when the hydraulic fluid is released from the support chamber into the relief chamber and where the crusher device is arranged to destruct the one or more glass layers.

2. Destruction mechanism according to claim 1, wherein the supporting hydraulic fluid is locked in the chamber by a releasable mechanism.

3. Destruction mechanism according to claim 2, wherein the releasable mechanism is triggered by means of a desired number of well pressure cycles from the well or by means of another signal.

4. Destruction mechanism according to claim 2, wherein the releasable mechanism is configured to release the hydraulic fluid into one or more relief chambers.

5. Destruction mechanism according to claim 4, wherein the pressure in the one or more relief chambers is lower than in the pressure support chamber prior to the release of the hydraulic fluid.

6. Destruction mechanism according to claim 4, wherein the pressure in the one or more relief chambers is approximately atmospheric prior to the release of the hydraulic fluid.

7. Destruction mechanism according to claim 1, where the crusher device comprises at least one or any combination of spikes, pins, pegs, knives, or annular casings.

8. Destruction mechanism for supporting and crushing a sealing device, wherein the sealing device comprises one or more glass layers positionable in a wellbore, characterized in that the destruction mechanism comprises:

a glass supporting sleeve arranged to support the one or more glass layers;

an axially displaceable sleeve member axially displaceable to cover and uncover a plurality of perforations;

a chamber arranged in between the glass supporting sleeve and the axially displaceable sleeve member, the chamber including a fluid;

a crusher device;

wherein the axially displaceable sleeve member is configured to move the crusher device diagonally into the one or more glass layers when the plurality of the perforations is uncovered.

9. Destruction mechanism according to claim 8, wherein the glass supporting sleeve is fixedly mounted in relation to the wellbore.

10. Destruction mechanism according to claim 8, wherein the fluid in the chamber has a lower pressure than the well pressure when positioned in the wellbore.

11. Destruction mechanism according to claim 8, wherein the fluid in the chamber has a higher pressure than the well pressure when positioned in the wellbore.

12. Destruction mechanism according to claim 8, wherein the fluid in the chamber comprises air or other gas.

13. Destruction mechanism according to one of the claim 8, wherein the axially displaceable sleeve member covers over a plurality of the perforations while in a barrier phase.

14. Destruction mechanism according to claim 13, wherein the axially displaceable sleeve member is displaceable into a crushing phase to uncover a plurality of the perforations.

15. Destruction mechanism according to claim 8, wherein a releasable mechanism is configured to be triggered by a number of well pressure cycles from the well above the sealing device or by another signal.

16. Destruction mechanism according to one of the claim 15, wherein the releasable mechanism is arranged behind the axially displaceable sleeve member.

17. Destruction mechanism according to one of the claim 15, wherein the releasable mechanism is in communication with the chamber.

18. Destruction mechanism according to one of the claim 15, wherein the axially displaceable sleeve member is displaceable into a crushing phase to uncover a plurality of the perforations and wherein the releasable mechanism in the crushing phase permits supporting hydraulic fluid to flow out into one or more relief chambers.

19. Destruction mechanism according to claim 18, wherein the pressure in the one or more relief chambers is lower than in the fluid-filled chamber prior to the crushing phase.

20. Destruction mechanism according to claim 18, wherein the pressure in the one or more relief chambers is approximately atmospheric before the crushing phase.

21. Destruction mechanism according to claim 8, wherein the axially displacing the axially displaceable sleeve into a crushing phase causes the crusher device to come into contact with and crush the glass, where the crusher device comprises any one or more or any combination of a spike, a pin, a peg, a knife, or an annular casing.

22. Destruction mechanism according to claim 21, wherein the crusher device comprises one or more spikes diagonally arranged at the glass, where the axially displaceable sleeve member is configured to strike an axial pin when moved into the crushing phase, causing a ball to function as a power transmission means around a turn.

* * * * *